United States Patent [19]

Beck

[11] Patent Number: 4,495,680

[45] Date of Patent: Jan. 29, 1985

[54] METHOD AND APPARATUS FOR FORMING A HELICAL WOUND SUBSTRATE COMPOSED SOLELY OF LONGITUDINAL YARNS

[75] Inventor: David A. Beck, Appleton, Wis.

[73] Assignee: Appleton Mills, Appleton, Wis.

[21] Appl. No.: 349,573

[22] Filed: Feb. 17, 1982

[51] Int. Cl.[3] ..... D04H 3/00; D04H 5/02

[52] U.S. Cl. ..... 28/100; 28/110; 28/142; 28/299

[58] Field of Search ..... 28/110, 142, 299, 100; 226/91, 92; 242/47, 47.03, 47.08

[56] References Cited

U.S. PATENT DOCUMENTS

| | | | |
|---|---|---|---|
| 2,232,500 | 2/1941 | Weaver | 242/47.03 |
| 2,525,760 | 10/1950 | Barker | 242/47.03 |
| 2,794,542 | 6/1957 | Vandenburgh et al. | 226/92 X |
| 2,943,379 | 7/1960 | Foltz, Jr. | 28/79 |
| 3,097,413 | 7/1963 | Draper, Jr. | 28/79 |
| 3,392,079 | 7/1968 | Fekete | 161/59 |
| 3,401,467 | 9/1968 | Koester | 34/95 |
| 3,458,911 | 8/1969 | Koester | 28/72.2 |
| 3,459,612 | 8/1969 | Lee et al. | 28/142 X |
| 3,492,706 | 2/1970 | Lee et al. | 242/47 X |
| 3,613,258 | 10/1971 | Jamieson | 34/95 |
| 3,879,820 | 4/1975 | Grieves et al. | 28/4 R |
| 3,920,511 | 11/1975 | Grieves et al. | 162/348 |

FOREIGN PATENT DOCUMENTS

| | | | |
|---|---|---|---|
| 382490 | 10/1923 | Fed. Rep. of Germany | 28/299 |
| 47-46634 | 11/1972 | Japan | 242/47 |
| 733651 | 7/1955 | United Kingdom | 242/47.03 |

*Primary Examiner*—Robert Mackey

*Attorney, Agent, or Firm*—Andrus, Sceales, Starke & Sawall

[57] ABSTRACT

A method and apparatus for forming a base fabric composed solely of warp yarns to be used in making a papermaker's felt. A plurality of yarns are drawn from a supply and wound around a pair of parallel drive rolls in a helical pattern by a travelling winding member. Two sets of parallel guide tines project from each end of the winding member. The corresponding ends of a plurality of loops are attached to the trailing ends of the first set of tines and pass around the rolls and the opposite ends of the loops are attached to the leading ends of the second set of tines. The yarns to be wound are attached to the trailing ends of the second set of tines. As the rolls rotate, the winding member travels in an endless path around the rolls to draw the yarns from the supply and wind the yarns in a helical pattern. A comb is located parallel to the rolls and the tines pass through the teeth of the comb to maintain proper spacing and order of the yarns as they are wound.

15 Claims, 6 Drawing Figures

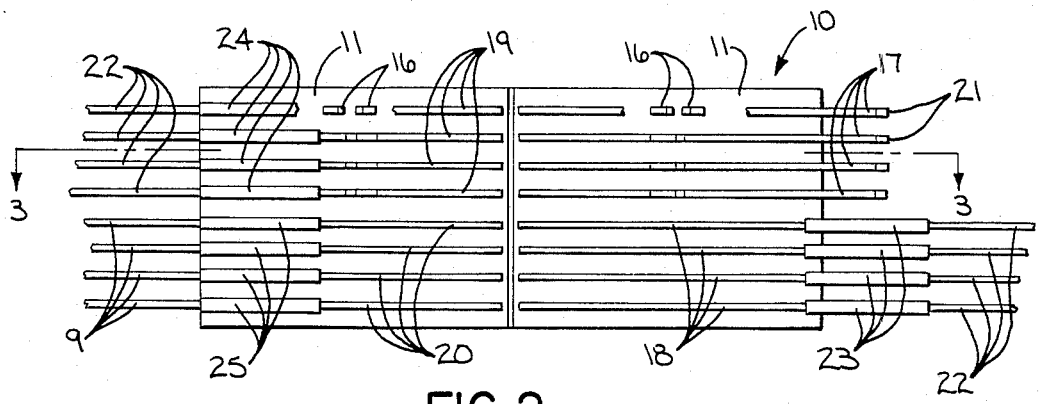
FIG. 2
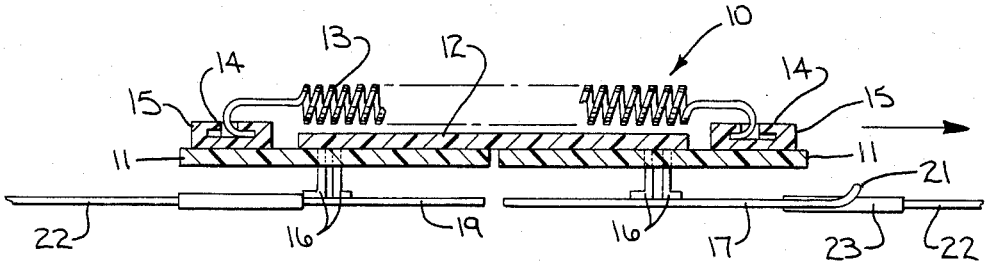
FIG. 3
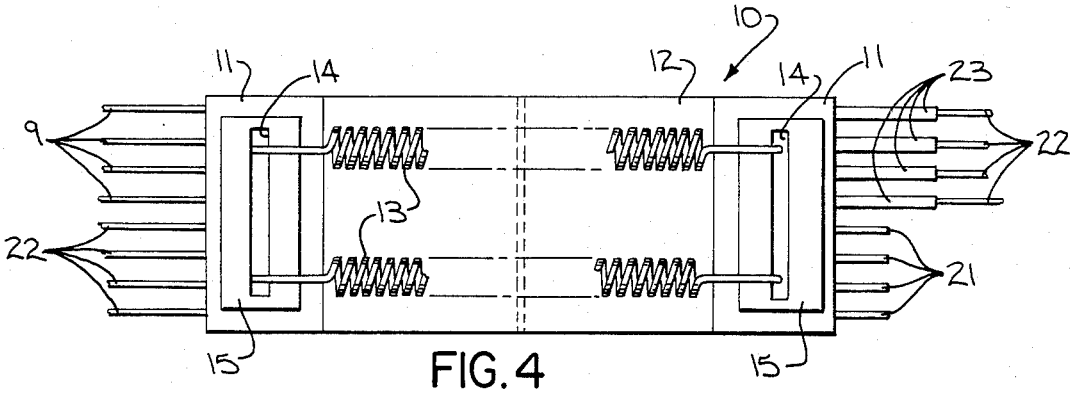
FIG. 4
FIG. 5
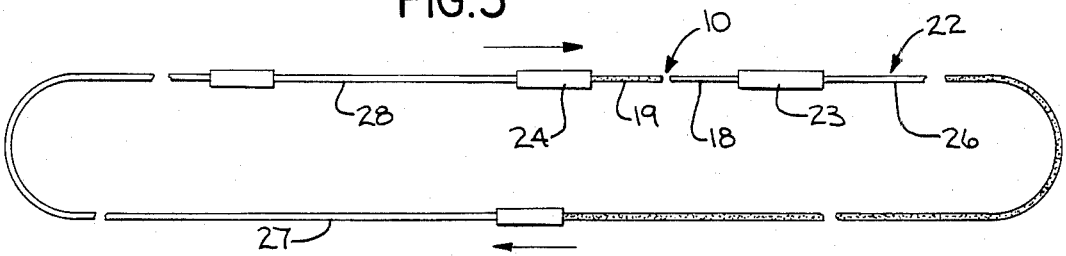

METHOD AND APPARATUS FOR FORMING A HELICAL WOUND SUBSTRATE COMPOSED SOLELY OF LONGITUDINAL YARNS

BACKGROUND OF THE INVENTION

Conventionally, papermaker's felts have been formed by weaving a fabric base and then needling fibrous batts to the base. The use of woven fabric has certain disadvantages. The fabric is normally woven in endless configuration on a loom and due to the size of the felt, a very lengthy set-up time is required before the weaving operation can begin. When fabricating felts of substantial size, it may take a group of workmen several days to set up the loom before weaving can commence. Furthermore, since felts are generally becoming larger, the size of the loom required is also becoming larger.

The shuttle, which is used in the conventional weaving operation to interleaf the cross yarns with the warp yarns, is only capable of containing a limited quantity of yarn and after deletion of the yarn, additional lengths of yarn must then be overlapped with the trailing end of the original length, resulting in pressure points in the completed felt.

As a further problem, the normal weaving process produces distortion of the yarns at the side edges of the woven fabric and non-uniformity in spacing between the yarns. The non-uniformity must normally be corrected through tedious manual operations.

A further disadvantage of utilizing a woven fabric in a papermaker's felt is that the points of crossover between the cross yarns and the warp yarns act as pressure points and can cause disfiguration of the paper web. It has also been recognized that cross yarns impede the drainage characteristics of the felt which can adversely affect the felts performance on the papermaking machine.

To overcome the disadvantages of a woven base fabric, attempts have been made in the past to minimize or eliminate the cross yarns (yarns that extend across the machine direction) in the base fabric. One proposal has been to minimize the number of cross yarns and to utilize cross yarns of fine denier. However, felts of this type still must be prepared by the conventional weaving process, and extreme care must be taken to maintain the integrity of the fine cross yarns during handling.

A second proposal, as suggested in the past, has been to use water soluble cross yarns. After the fabric is woven by conventional weaving processes and subsequently needled, the felt is subjected to a water treatment to dissolve the cross yarns.

Another proposed, as set forth in U.S. Pat. No. 3,097,413, is to lay the warp yarns on a watersoluble plastic film, and after needling, the felt is subjected to a water treatment to dissolve the film, with the result that the finished felt contains only longitudinal yarns without cross yarns.

SUMMARY OF THE INVENTION

The invention is directed to a method and apparatus for forming a base fabric, composed solely of machine direction or longitudinal yarns, that has particular use in producing a papermaker's felt. In accordance with the invention, a plurality of yarns or strands are drawn from a supply and wound around a pair of parallel drive rolls in a helical pattern by a travelling winding member. Two sets of parallel guide tines project from each end of the winding member. The corresponding ends of a group of flexible loops, formed of yarns or strands, are attached to the trailing ends of the first set of guide tines and pass around the rolls and the opposed ends of the loops are attached to the leading ends of the second set of tines. The yarns to be wound are connected to the trailing ends of the second set of tines.

As the rolls rotate, the winding member travels in an endless path around the rolls to thereby draw the yarns from the supply and wind the yarns in a helical pattern about the rolls. A comb, or other spacing device, is located parallel to the rolls and during the winding process, when the winding member encounters the comb, the tines on the winding member pass through the teeth of the comb with the comb maintaining the proper spacing and order of the yarns as they are wound about the rolls.

To facilitate passage of the winding member around the rolls, the winding member is flexible, preferably being composed of a plurality of hinged sections which permit the winding member to conform to the contour of the roll as it passes around the roll. A spring or other biasing member can be utilized to urge the winding member to a generally flat configuration as it travels in the upper and lower runs between the drive rolls.

The apparatus of the invention produces an array of helically disposed yarns or strands to which fibrous batting or other nonwoven material can be subsequently applied and adhered thereto to provide a papermaker's felt. The resulting felt is fillingless, meaning that there are no cross-direction yarns. By eliminating the cross direction yarns, the drainage characteristics of the felt are improved and pressure points caused by yarn crossovers are eliminated and if knotless yarn is used, knots are also eliminated.

The method of the invention requires a minimum set-up time and enables the base fabric to be produced in a substantially reduced period of time, as compared to fabrics produced by conventional weaving processes.

Other objects and advantages will appear in the course of the following description.

DESCRIPTION OF THE DRAWINGS

The drawings illustrate the best mode presently contemplated of carrying out the invention.

In the drawings:

FIG. 2 is an enlarged bottom view of the winding member showing the attachments of the loop and the yarns;

FIG. 3 is a section taken along line 3—3 of FIG. 2;

FIG. 4 is a top view of the winding member;

FIG. 5 is a diagrammatic view of the loop; and

DESCRIPTION OF THE ILLUSTRATED EMBODIMENT

Figure 1:
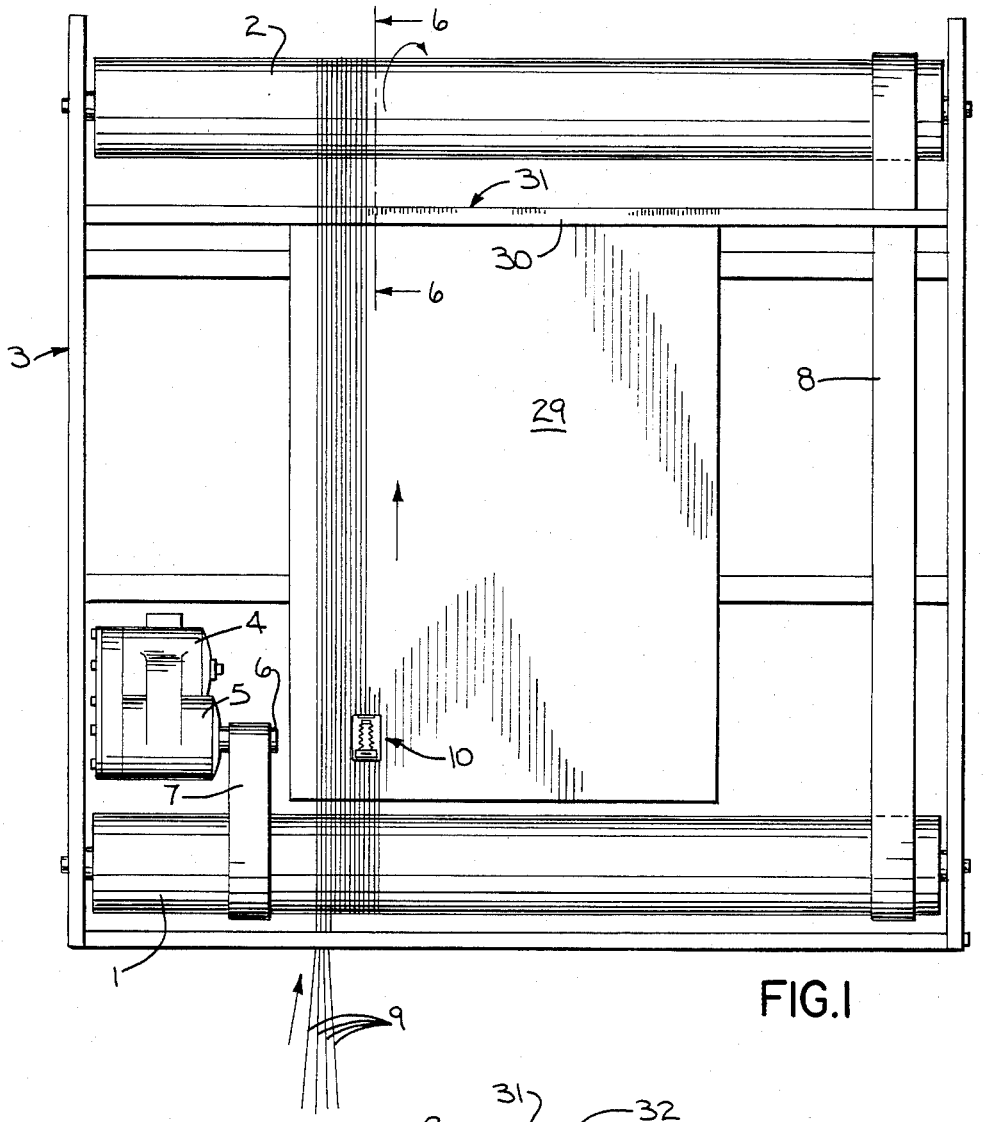
FIG. 1 is a top plan view of the apparatus of the invention.

As illustrated in FIG. 1, the apparatus for forming the base fabric includes a pair of drive rolls 1 and 2 which are journalled for rotation within a supporting structure or frame 3. One side of the frame can be removable to facilitate removal of the helically wound substrate after the winding has been completed.

To drive the rolls, a motor 4 is mounted on the frame 3 and acts through a gear box 5. The output shaft 6 of gear box 5 is connected through belt 7 to roll 1. With this construction, operation of the motor 4 will drive the roll 1, and rotation of the roll 1 is transmitted, in turn, to roll 2 by belt 8 which connects the rolls 1 and 2. Alternately, roll 2 can be driven by other conventional drive systems, such as pneumatic or hydraulic systems.

A plurality of yarns or strands 9 which are contained on a creel, not shown, are adapted to be wound in helical pattern on the rolls 1 and 2 by a travelling winding member 10. The term "yarn" as used in the specification and claims is intended to include strands of monofilament, multifilament, fiber materials, or mixtures of these materials in either twisted, untwisted, intertwined, or plied form. The yarns can be formed of any desired materials, such as wool or synthetic materials.

The construction of the winding member 10 is best illustrated in FIGS. 2–4. As shown, the winding member includes a pair of generally flat base sections 11 which are connected by a flexible strap 12, made of plastic or the like, and serve as a hinge for the two base sections. Alternately, the winding member can have multiple hinges or have a flexible base to allow bending. The winding member 10 is elongated and as the rolls 1 and 2 have relatively small diameters, the flexible construction of the base sections 11 permits the winding member to partially conform to the contour of the rolls as the winding member passes around the rolls during its travel.

To maintain the base sections 11 in a generally planar condition as the winding member passes in the upper and lower runs betweens rolls 1 and 2, a pair of springs 13 are mounted on the outer surface of the base sections 11, and the ends of the springs are engaged within slots 14 in brackets 15 which are mounted on the outer surfaces of the base sections 11. The force of the springs 13 will urge the base sections 11 into a generally planar condition, as the winding member travels in its upper and lower runs between the rolls 1 and 2.

A plurality of metal feet 16 extend inwardly from the base sections 11 and four sets of guide wires or tines 17, 18, 19 and 20 are attached to the corresponding feet 16. As illustrated in FIG. 2, there are four of each of the guide tines 17–20, but this number can vary, depending on the product being produced. The guide tines 17 and 18 project forwardly from the winding member 10 in the direction of travel of the winding member, while the guide tines 19 and 20 project rearwardly. As best illustrated in FIG. 3, the ends of the guide tines 17 are bent upwardly, as indicated by 21.

Flexible loops 22 are connected between the individual guide tines 18 and 19, and the loops, as best shown in FIG. 5 pass around the rolls 1 and 2. Corresponding ends of the loops 22 may be connected to the guide tines 18 by means of heat shrinkable plastic tubes or sleeves 23. In this regard, the respective ends of the guide tines 18 and the loops 22 are inserted within the opposite ends of the sleeves 23 and on heating, the sleeves will shrink to provide a firm attachment between the two members. The sleeves can be made of a conventional heat shrinkable plastic material, such as Teflon, nylon, or the like. Alternately, other methods of attachment can be used, such as braided tubing or soldering. However, it is desired to provide a connection without knots or projections and which will result in a minimum increase in diameter at the connecting junction.

The opposite ends of the loops 22 are connected to the guide tines 19 through heat-shrinkable sleeves 24 which are similar to tubes 23. In addition, the outer ends of the guide tines 20 are connected to the individual yarns 9 through heat-shrinkable tubes or sleeves 25.

With this construction, rotation of the rolls 1 and 2 will cause the winding member 10 to travel around the rolls and draw the yarns 9 around the rolls in a helical pattern.

The specific construction of the loops 22 is best illustrated in FIG. 5. Each loop 22 is composed of an end section 26 which is connected to the guide tine 18, and is formed of rubber coated yarn. The rubber coating provides increased frictional resistance between the loop and the drive rolls to prevent slipping of the loop and insure that the yarn will be drawn onto the drive rolls. The opposite end of the section 26 is connected to a length of elastic yarn 27, and the opposite end of the elastic section 27 is connected in turn to a metal wire section 28 which is attached to the guide tine 19 through the sleeve 23. The elastic loop section 27, which can comprise up to about 40% of the length of the loop, enables the loop to be employed for producing base fabrics of different lengths in which the distance between the drive rolls 1 and 2 is varied. The metal section 28 provides less frictional resistance and permits slippage of the loop behind the winding member 10 in the direction of travel. The sections 26, 27 and 28 can be connected together by heat shrinkable sleeve couplings, similar to sleeves 23. To maintain tension in the yarns 9, the sections 26–28 of loop 22, should preferably have a larger diameter than yarns 9.

Figure 6:
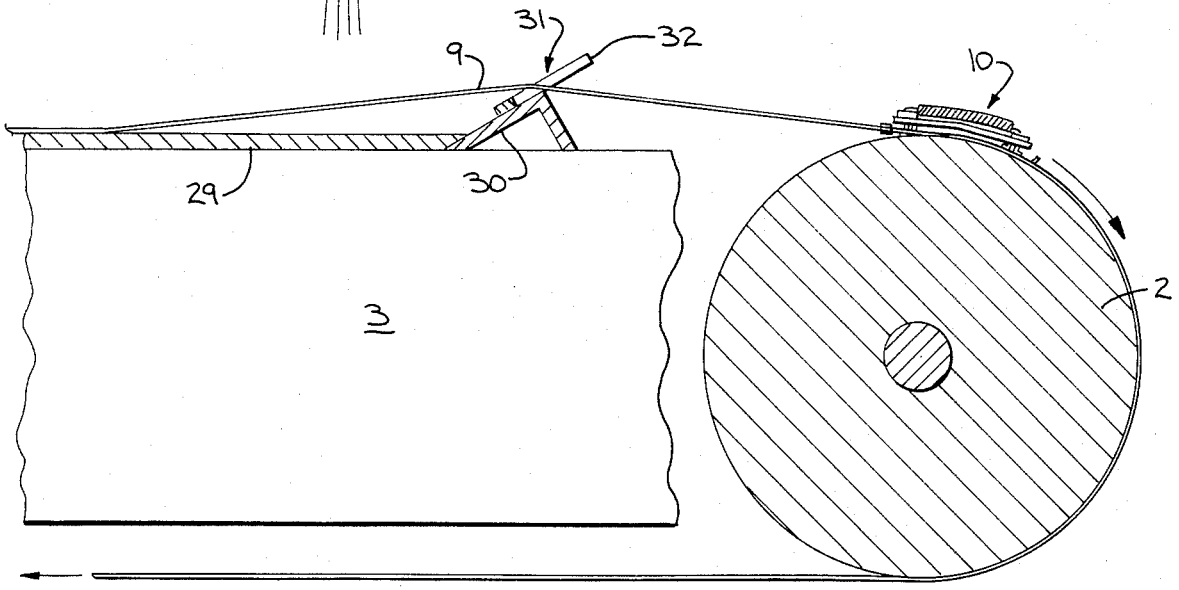
FIG. 6 is an enlarged elevation showing the comb and the winding member passing over a drive roll.

The winding member 10 is supported in its upper run by a generally flat surface or table 29, which, as illustrated, is mounted on the frame 3. If desired, a flat surface or table can also be employed to support the lower run of the winding member. Located at the end of the table 29 adjacent to roll 2 is an angle iron 30, and a comb 31, or other fixture with a plurality of spaced teeth 32, is mounted on the angle iron 30. As best shown in FIG. 6, the teeth of the comb are disposed at an adjustable angle of about 20° to 40° with respect to the horizontal and preferably about 30°. As the winding member 10 approaches the roll 2, the guide tines 17 and 18 will pass between the spacing members or teeth 32 to maintain the proper spacing of the yarns 9 as they are being wound in the helical pattern.

While the drawings illustrate the use of a comb 31 with teeth 32 to space the yarns, it is contemplated that other spacing means can be employed, such as grooved rolls or the like.

In operation of the apparatus, the ends of the loops 22 are connected to the guide tines 18, as well as the guide tines 19, through use of the heat shrinkable tubes 23 and 24, or other connecting members. As previously noted, the drawings show four guide tines in each set, but it is contemplated that any number may be employed. The leading ends of the yarns 9 are then similarly attached to the guide tines 20. With the yarns attached to the connecting member 10, the rolls 1 and 2 are rotated through operation of the motor 4, causing the winding member 10 to travel in an endless path around the rolls 1 and 2 and wind the yarns in a helical pattern. As the connecting member 10 approaches the comb 31, the guide tines 17 and 18 will ride in the spaces between the teeth 32 of the comb. The hinge connection provided by the flexible strap 12 enables the connecting member 10 to partially conform to the circular contour of the rolls, as the connecting member passes over the rolls, as best shown in FIG. 6.

The apparatus of the invention provides an array of helically disposed yarns which can be subsequently needled with fibrous batting to produce all or part of a papermaker's felt or other fabric. The needling operation can be carried on directly on the winding apparatus, or alternately, the array of helical yarns can be removed from the rolls 1 and 2 and subsequently installed on a conventional needling machine. Pressure sensitive adhesive tape can be spread transversely across the array of helical yarn to maintain the proper spacing, if the yarns are to be transferred to a needling machine.

The resulting needled felt does not contain cross yarns and this provides a substantial improvement in drainage characteristics, as well as providing greater uniformity of surface texture.

Through use of the method of the invention, the time for producing the fibrous substrate can be greatly reduced over conventional weaving methods.

Various modes of carrying out the invention are contemplated as being within the scope of the following claims particularly pointing out and distinctly claiming the subject matter which is regarded as the invention.

I claim:

1. An apparatus for producing a helical wound substrate copmposed solely of longitudinally extending yarns, comprising a pair of parallel rolls, drive means to drive at least one of said rolls, a winding member having first and second elongated guides extending forwardly from one end of the winding member and having third and fourth guides extending from the opposite end of the winding member, said first guide being longitudinally aligned with said third guide and said second guide being longitudinally aligned with said fourth guide, a loop having one end connected to the second guide and the opposite end connected to said third guide, said loop extending around said rolls, connecting means for connecting the leading end of a yarn to said fourth guide, and guide means disposed generally parallel to said rolls and having a plurality of spaced guideways, said guides being received within the guideways as said winding member moves in its path of travel, operation of said drive means causing said winding member to travel around said rolls in an endless path to thereby wind said yarns in a helical pattern on said rolls.

2. The apparatus of claim 1, wherein said winding member is disposed to travel between said rolls in an outer run and an inner run, and said apparatus includes a platform disposed beneath the outer run to support the winding member in movement as it travels in said outer rim.

3. The apparatus of claim 2, wherein said guideways are disposed at an angle of 20° to 40° to the horizontal.

4. The apparatus of claim 1, including a plurality of first, second, third and fourth guides, and a plurality of loops connecting the respective second guides and said third guides, and said connecting means including means for attaching a plurality of yarns to the respective fourth guides.

5. The apparatus of claim 1, wherein said winding member includes a flexible base capable of at least partially conforming to the curvature of said rolls as the winding member moves around said rolls.

6. The apparatus of claim 5, wherein said base is composed of a pair of sections separated by a transverse joint, and said winding member includes hinge means connected to said sections and extending across said joint to permit said base to flex.

7. The apparatus of claim 6, and including biasing means interconnecting said sections and disposed to urge the sections into a generally planar configuration.

8. The apparatus of claim 1, wherein said loop includes an elastic section.

9. The apparatus of claim 1, wherein said loop includes a first section having one end connected to said second guide and having a coating of high frictional resistance, a second elastic section having one end connected to the opposite end of said first section, and a third metal section having one end connected to the opposite end of said second section and the opposite end of said third section being connected to said third guide.

10. The apparatus of claim 1, wherein said connecting means comprises a tubular open-ended sleeve, said fourth guide and said yarn being connected within the opposite open ends of said sleeve.

11. An apparatus for producing a helical wound substrate composed solely of longitudinally extending yarns, comprising a pair of parallel rolls, drive means to drive at least one of said rolls, a winding member having a plurality of both first and second wire-form guides extending forwardly in spaced parallel relation from one end of the winding member and having a plurality of both third and fourth wire form guides extending rearwardly in spaced parallel relation from the opposite end of said winding member, a plurality of loops, corresponding ends of said loops being connected to the respective second guides and opposite corresponding ends of said loops being connected to said third guides, said loops extending in parallel relation around said rolls, connecting means for connecting the leading ends of a plurality of yarns to the respective fourth guides, operation of said drive means causing said winding member to travel around said rolls in an endless path to thereby wind said yarn in a helical pattern on said rolls, and fixed spacing means having a plurality of spaced slots to receive said first and second guides as said winding member travels around said rolls for spacing said yarns apart.

12. The apparatus of claim 11, and including a plurality of tubular open-ended connecting members for connecting the ends of said loops to the respective second and third guides.

13. An apparatus for producing an endless helically wound substrate composed solely of longitudinally extending yarns, comprising a pair of parallel smooth surfaced rolls, drive means to drive at least one of said rolls, a winding member having a leading end and a trailing end, an endless loop disposed around the rolls with one end of said loop connected to the leading end of the winding member and the opposite end of the loop being connected to the trailing end of the winding member, the connections of said loop to said winding member being offset laterally, a plurality of generally parallel yarns connected to the trailing end of the winding member and disposed generally parallel to said loop, spacing means spaced from one of said rolls and having a plurality of spaced guideways to receive and space said yarns, operation of said drive means causing said loop to travel in an endless path around said rolls to wind said yarns in a generally helical pattern on said rolls.

14. A method of forming a helically wound substrate composed solely of longitudinally extending yarns, comprising the steps of mounting a loop around a pair of spaced parallel smooth surfaced guide members, connecting a first end of the loop to a forward end of a winding member at a first connection, connecting a second end of the loop to the rear of the winding member at a second connection spaced laterally from said first connection, connecting the leading ends of a plurality of spaced generally parallel yarns contained on a supply to the rear end of said winding member at a location in general longitudinal alignment with said first connection, moving said winding member forwardly in an endless path of travel around said guide members to draw the yarns from said supply and wind said yarns in helical convolutions about said guide members, and maintaining the wound yarns in spaced parallel relation by passing said wound yarns through said spaced guideways located in spaced relation to said guide members.

15. The method of claim 14, and including the step of positioning longitudinally extending guides on the inner surface of said winding member, and passing said guides through uniformly spaced slots as the winding member moves in its path of travel to thereby maintain uniform spacing and order of said convolutions.

* * * * *

UNITED STATES PATENT AND TRADEMARK OFFICE

CERTIFICATE OF CORRECTION

PATENT NO. : 4,495,680

DATED : January 29, 1985

INVENTOR(S) : DAVID A. BECK

It is certified that error appears in the above-identified patent and that said Letters Patent is hereby corrected as shown below:

Col. 5, Line 51, CLAIM 2 Cancel "rim" and substitute therefor ---run---.

Signed and Sealed this

*Twenty-fourth* Day of *September 1985*

[SEAL]

*Attest:*

DONALD J. QUIGG

*Attesting Officer*

*Commissioner of Patents and Trademarks—Designate*